US006024429A

United States Patent [19]

Coffy et al.

[11] Patent Number: 6,024,429

[45] Date of Patent: Feb. 15, 2000

[54] MAILING MACHINE INCLUDING INK JET PRINTING HAVING INK AVAILABILITY CHECKING

[75] Inventors: Jean-Hiram Coffy, Norwalk; Jerome E. Jackson, Newtown; Edilberto I. Salazar, Brookfield; Christopher D. Smith, Milford, all of Conn.

[73] Assignee: Pitney Bowes Inc., Stamford, Conn.

[21] Appl. No.: 08/960,872

[22] Filed: Oct. 30, 1997

[51] Int. Cl.[7] ..... B41J 2/195

[52] U.S. Cl. ..... 347/7; 347/86; 347/19

[58] Field of Search ..... 347/7, 86, 19; 399/57, 58, 59, 61, 62

[56] References Cited

U.S. PATENT DOCUMENTS 5,068,806 11/1991 Gatten ..... 395/113
5,574,484 11/1996 Cowger ..... 347/7
5,731,824 3/1998 Kneezel ..... 347/7
5,835,817 11/1998 Bullock et al. ..... 399/25
5,860,363 1/1999 Childers et al. ..... 101/483
5,894,313 4/1999 Mabuchi ..... 347/7
5,966,144 10/1999 Edwards ..... 347/7

*Primary Examiner*—Richard Moses
*Attorney, Agent, or Firm*—Angelo N. Chaclas; Michael E. Melton

[57] ABSTRACT

An ink jet printer comprising a replaceable cartridge having a supply of ink and a controller in operative communication with the cartridge. The controller keeps an estimate of an amount of ink remaining in the cartridge and provides a signal indicating that the cartridge is to be weighed in response to a predetermined event. A method of operating an ink jet printer, a postage printing apparatus and a method of operating a postage printing system are also provided.

26 Claims, 4 Drawing Sheets

MAILING MACHINE INCLUDING INK JET PRINTING HAVING INK AVAILABILITY CHECKING

FIELD OF THE INVENTION

This invention relates to an ink jet printer including a disposable ink cartridge where the ink jet printer includes the capability of checking the amount of ink remaining in the cartridge. More particularly, this invention is directed to a postage printing apparatus including an ink jet printer having an ink jet cartridge wherein the postage printing apparatus prompts an operator to remove and weigh the ink jet cartridge to determine the amount of ink remaining in response to a predetermined event.

BACKGROUND OF THE INVENTION

Ink jet printers are well known in the art. Generally, an ink jet printer includes an array of nozzles or orifices, a supply of ink, a plurality of ejection elements (typically either expanding vapor bubble elements or piezoelectric transducer elements) corresponding to the array of nozzles and suitable driver electronics for controlling the ejection elements. Typically, the array of nozzles and the ejection elements along with their associated components are referred to as a print head. It is the activation of the ejection elements that causes drops of ink to be expelled from the nozzles. The ink ejected in this manner forms drops which travel along a flight path until they reach a print medium such as a sheet of paper, overhead transparency, envelope or the like. Once they reach the print medium, the drops dry and collectively form a print image. Typically, the ejection elements are selectively activated or energized as relative movement is provided between the print head and the print medium so that a predetermined or desired print image is achieved.

Generally, the array of nozzles, supply of ink, plurality of ejection elements and driver electronics are packaged into an ink jet cartridge. In turn, the printer includes a carriage assembly for detachably mounting the ink jet cartridge thereto. In this manner, a fresh ink jet cartridge may be installed when the ink supply of the current ink cartridge has been consumed. Some ink jet printers provide an indication to the user that the ink supply is running low while others do not. In either case, the printer continues to operate with the result being that the user must recognize when the ink supply is exhausted. Thus, it is generally intended for the ink jet cartridges to be disposable.

Recently, the postage meter industry and other envelope printing industries have begun to incorporate ink jet printers. A typical postage meter (one example of a postage printing apparatus) applies evidence of postage, commonly referred to as a postal indicia, to an envelope or other mailpiece and accounts for the value of the postage dispensed. As is well known, postage meters include an ascending register, that stores a running total of all postage dispensed by the meter, and a descending register, that holds the remaining amount of postage credited to the meter and that is reduced by the amount of postage dispensed during a transaction. Because U.S. Postal Service regulations require that postage be paid in advance, it had traditionally been required that the user of a postage meter periodically present the meter to a Postal Service employee for recharging. However, more recently it is possible to recharge a meter remotely using telephone communications. At the time of recharging, the user paid to the Postal Service the amount of postage to be credited to the meter and the meter is recharged by increasing the setting of the descending register by the amount paid. The postage meter generally also includes a control sum register which provides a check upon the descending and ascending registers. The control sum register has a running account of the total funds being added into the meter. The control sum register must always correspond with the summed readings of the ascending and descending registers. The control sum register is the total amount of postage ever put into the machine and it is alterable only when adding funds to the meter. In this manner, the dispensing of postal funds may be accurately tracked and recorded.

Due to the inherent nature of printing an indicia of value (a postal indicia being the equivalent of money), several issues arise with utilizing ink jet printing in a postage printing device. For example, if a general purpose ink jet printer runs out of ink while printing a document, then the user merely installs a new cartridge and reprints the document. On the other hand, if a postage printing device runs out of ink while printing a postal indicia, then the user loses money because the postal funds associated with that postal indicia cannot be recovered. Therefore, it is desirable to avoid running out of ink while printing a postal indicia.

Complicating this issue is the practical effect that current techniques for determining how much ink remains in the ink jet cartridge suffer from various drawbacks. Passive techniques estimate the amount of ink that remains by counting the drops that are ejected and subtracting a given volume of ink for each drop from the supply of ink. However, the drop volumes vary according to the operating conditions such as: temperature, humidity, and variable sensitivity of the ejection elements to the drive signals between different ink jet cartridges and over the life of the cartridge. Thus, these techniques are only somewhat accurate. Active techniques estimate the amount of ink that remains by physical measurement of the supply. This may be accomplished by a variety of known methods such as employing a thermistor to detect the changing level of the ink supply in the reservoir. However, these techniques add to the hardware complexity and cost of the ink jet cartridge. Additionally, these techniques are also only accurate to within a certain range. For example, inaccuracies in measuring the ink remaining are introduced due to a non-level printer module, excessive vibrations, calibration errors and the like.

Furthermore, there are no assurances that the cartridges were full when they were installed. Thus, the assumption that brand new cartridges are installed each time may not be correct resulting in further inaccuracies.

Although on the one hand, operators want to avoid running out of ink while printing a postal indicia so as not to lose postal funds; on the other hand, operators want to print as many postal indicias per cartridge as possible so as to lower their operating costs. Thus, these two objectives are in conflict. Running out of ink is undesirable because of the lost customer postal funds. Disposing of cartridges while they still have usable ink remaining is undesirable because the remaining ink has been paid for but never used resulting in an increase in the cost of consumable supplies or cost per postal indicia dispensed.

Therefore, there is a need for a postage printing apparatus that prevents printing a postal indicia if an out of ink condition is near, overcomes the inaccuracies of passive measurement techniques and does not introduce the cost of active measurement techniques. In this way, the cost of the ink jet cartridge is spread over as many envelopes as possible and the overall cost of the postage printing apparatus is reduced.

SUMMARY OF THE INVENTION

The present invention provides a cost effective apparatus and method for keeping track of an amount of ink remaining in a replaceable cartridge and allowing postal indicias to be printed so long as the risk of running out of ink is remote. To accomplish this, the cartridge is weighed in response to a predetermined event and a more accurate amount of ink remaining is determined using the weight.

In conventional fashion, this invention may be incorporated into a variety of devices employing ink jet printing, such as: a postage meter mailing machine, a postage meter, a postage printing apparatus or system or a general purpose ink jet printer.

In accordance with the present invention, there is provided an ink jet printer comprising a replaceable cartridge having a supply of ink and a controller in operative communication with the cartridge. The controller keeps an estimate of an amount of ink remaining in the cartridge and, in response to a predetermined event, it provides a signal indicating that the cartridge is to be weighed.

A method of operating an ink jet printer, a postage printing apparatus and a method of operating a postage printing system are also provided.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Postage meter mailing machines are well known in the art. Generally, mailing machines are readily available from manufacturers such as Pitney Bowes Inc. of Stamford, Conn. Mailing machines often include a variety of different modules which automate the processes of producing mailpieces. The typical mailing machine includes a variety of different modules or sub-systems where each module performs a different task on the mailpiece, such as: singulating (separating the mailpieces one at a time from a stack of mailpieces), weighing, moistening/sealing (wetting and closing the glued flap of an envelope), applying evidence of postage, accounting for postage used and stacking finished mailpieces. However, the exact configuration of each mailing machine is particular to the needs of the user. Customarily, the mailing machine also includes a transport apparatus which feeds the mailpieces in a path of travel through the successive modules of the postage meter mailing machine.

Figure 1:
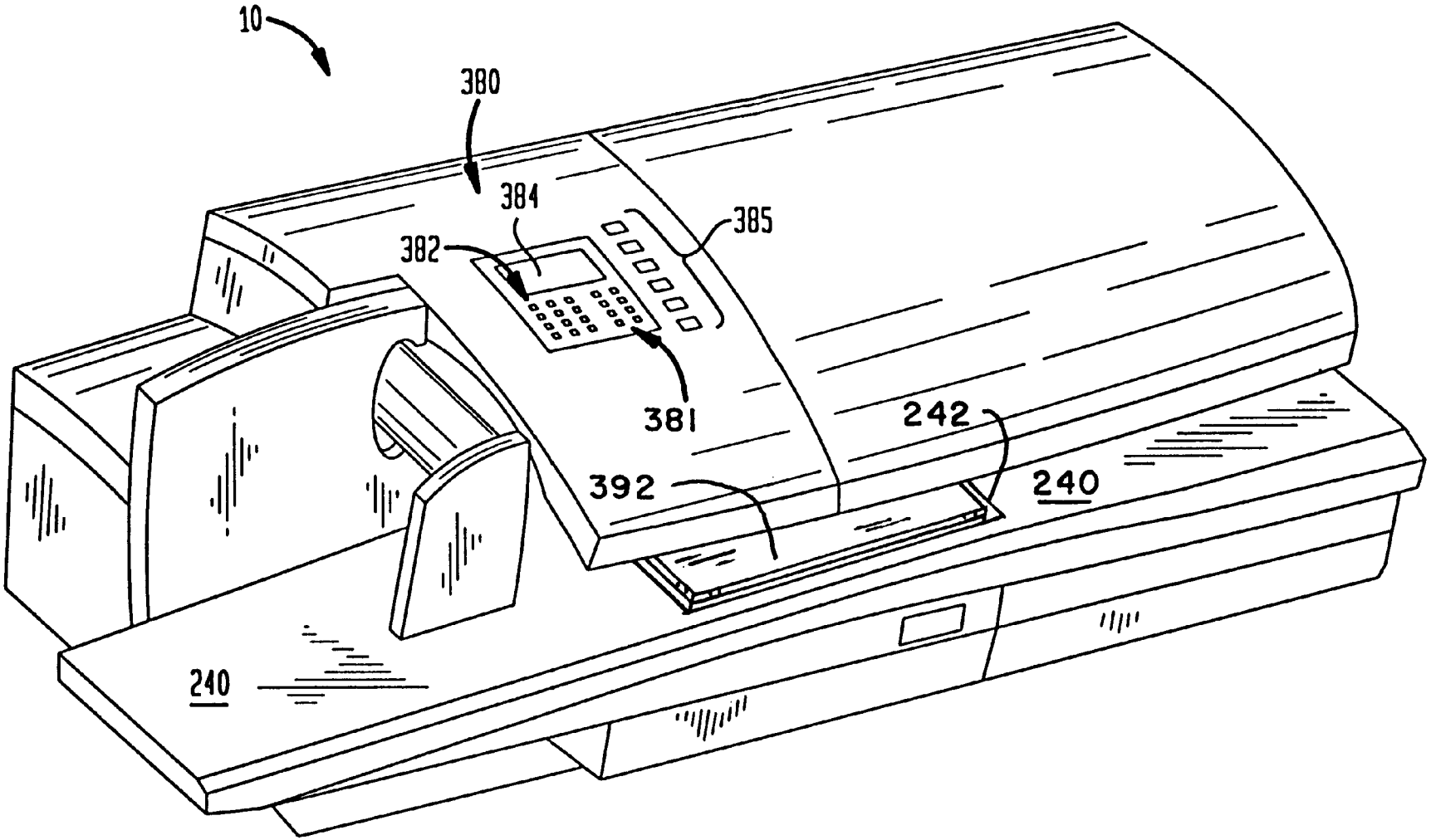
FIG. 1 is a simplified perspective view of a mailing machine that incorporates the present invention.

Referring to FIG. 1, a mailing machine 10 including a feed deck 240 and a user interface 380 having a resident display/keyboard 381 including a keypad 382 and a display 384 and a set of function keys 385 is shown. The feed deck 240 includes an opening 242 through which a platform 392 of a scale module 390 (not shown) extends. Further details of the mailing machine 10 will be provided in the remaining Figures and the written text below.

Figure 2:
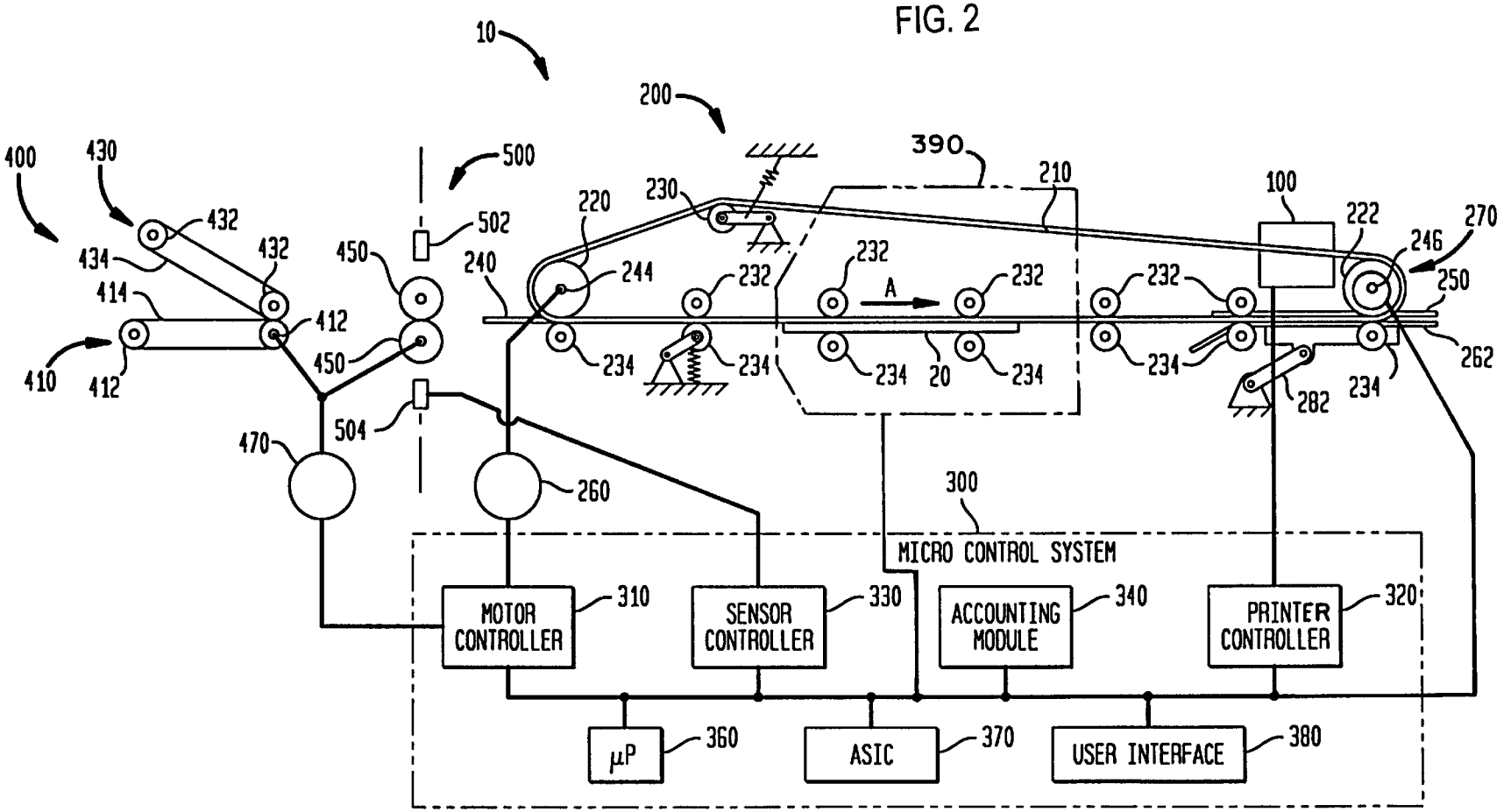
FIG. 2 is a simplified schematic of a front elevational view of a mailing machine which incorporates the present invention.

Referring to FIG. 2, an simplified schematic of an elevational view of the mailing machine 10 is shown. The mailing machine 10 includes a printer module 100, a conveyor apparatus 200, a micro control system 300, a singulator module 400 and the scale module 390. Other modules of the mailing machine 10, such as those described above, have not been shown for the sake of clarity. The singulator module 400 receives a stack of envelopes (not shown), or other mailpieces such as postcards, folders and the like, and separates and feeds them in a seriatim fashion (one at a time) in a path of travel as indicated by arrow A. Downstream from the path of travel, the conveyor apparatus 200 feeds the envelopes 20 in the path of travel along the deck 240 past the printer module 100 so that a postal indicia can be printed on each envelope 20. Together, the singulator module 400 and the conveyor module 200 make up a transport apparatus for feeding the envelopes 20 through the various modules of the mailing machine 10.

The singulator module 400 includes a feeder assembly 410 and a retard assembly 430 which work cooperatively to separate a batch of envelopes (not shown) and feed them one at a time to a pair of take-away rollers 450. The feeder assembly 410 includes a pair of pulleys 412 having an endless belt 414 extending therebetween. The feeder assembly 410 is operatively connected to a motor 470 by any suitable drive train which causes the endless belt 414 to rotate clockwise so as to feed the envelopes in the direction indicated by arrow A. The retard assembly 430 includes a pair of pulleys 432 having an endless belt 434 extending therebetween. The retard assembly 430 is operatively connected to any suitable drive means (not shown) which causes the endless belt 434 to rotate clockwise so as to prevent the upper envelopes in the batch of envelopes from reaching the take-away rollers 450. In this manner, only the bottom envelope in the stack of envelopes advances to the take-away rollers 450. Those skilled in the art will recognize that the retard assembly 430 may be operatively coupled to the same motor as the feeder assembly 410.

The take-away rollers 450 are located adjacent to and downstream in the path of travel from the singulator module 400. The take-away rollers 450 are operatively connected to motor 470 by any suitable drive train (not shown). Generally, it is preferable to design the feeder assembly drive train and the take-away roller drive train so that the take-away rollers 450 operate at a higher speed than the feeder assembly 410. Additionally, it is also preferable that the take-away rollers 450 have a very positive nip so that they dominate control over the envelope 20. Consistent with this approach, the nip between the feeder assembly 410 and the retard assembly 430 is suitably designed to allow some degree of slippage.

The mailing machine 10 further includes a sensor module 500 which is substantially in alignment with the nip of take-away rollers 450 for detecting the presence of the envelope 20. Preferably, the sensor module 500 is of any conventional optical type which includes a light emitter 502 and a light detector 504. Generally, the light emitter 502 and the light detector 504 are located in opposed relationship on opposite sides of the path of travel so that the envelope 20 passes therebetween. By measuring the amount of light that the light detector 504 receives, the presence or absence of the envelope 20 can be determined. Generally, by detecting the lead and trail edges of the envelope 20, the sensor module 500 provides signals to the micro control system 300 which are used to determine the length of the envelope 20 and measure the gap between successive envelopes 20.

The conveyor apparatus 200 includes an endless belt 210 looped around a drive pulley 220 and an encoder pulley 222 which is located downstream in the path of travel from the drive pulley 220 and proximate to the printer module 100. The drive pulley 220 and the encoder pulley 222 are substantially identical and are fixably mounted to respective shafts (not shown) which are in turn rotatively mounted to any suitable structure (not shown) such as a frame. The drive pulley 220 is operatively connected to a motor 260 by any conventional means such as intermeshing gears (not shown) or a timing belt (not shown) so that when the motor 260 rotates in response to signals from the micro control system 300, the drive pulley 220 also rotates which in turn causes the endless belt 210 to rotate and advance the envelope 20 along the path of travel.

The conveyor apparatus 200 further includes a plurality of idler pulleys 232, a plurality of normal force rollers 234 and a tensioner pulley 230. The tensioner pulley 230 is initially spring biased and then locked in place by any conventional manner such as a set screw and bracket (not shown). This allows for constant and uniform tension on the endless belt 210. In this manner, the endless belt 210 will not slip on the drive pulley 220 when the motor 260 is energized and caused to rotate. The idler pulleys 232 are rotatively mounted to any suitable structure (not shown) along the path of travel between the drive pulley 220 and the encoder pulley 222. The normal force rollers 234 are located in opposed relationship and biased toward the idler pulleys 232, the drive pulley 220 and the encoder pulley 222, respectively.

As described above, the normal force rollers 234 work to bias the envelope 20 up against the deck 240. This is commonly referred to as top surface registration which is beneficial for ink jet printing. Any variation in thickness of the envelope 20 is taken up by the deflection of the normal force rollers 234. Thus, a constant space (the distance between the printer module 100 and the deck 240) is set between the envelope 20 and the printer module 100 no matter what the thickness of the envelope 20. The constant space is optimally set to a desired value to achieve quality printing. It is important to note that the deck 240 contains suitable openings (not shown) for the conveyor apparatus 200.

The scale module 390 may be of any conventional type such as a load cell (not shown) based system. Included within the tare weight of the scale module 390 is the conveyor apparatus 200. In this manner, the weight of each individual envelope 20 may be measured and supplied to the micro control system 300 so that the correct amount of postage may be determined and printed on the envelope 20. Additionally, the scale module 390 includes the platform 392 which is also part of the tare weight of the scale module 390. The platform 392 extends along the deck 240 toward the front of the mailing machine 10 (the operator's position). In this manner, an oversized envelope 20 may still be weighed accurately because in the weighing position the oversized envelope 20 rests on the platform 392 and not on any surface that is not part of the tare weight of the scale module 390.

The scale 390, the sensor module 500, the singulator module 400, conveyor apparatus 200 and the printer module 100 are under the control of the micro control system 300 which may be of any suitable combination of microprocessors, firmware and software. The micro control system 300 includes a motor controller 310 which is in operative communication with the motors 260 and 470, a printer controller 320 which is in operative communication with the printer module 100, a sensor controller 330 which is in operative communication with the sensor module 500; an accounting module 340 for authorizing and accounting for the dispensing of postal funds; a microprocessor 360; a security application specific integrated circuit (ASIC) 370 and the user interface 380. The motor controller 310, the printer controller 320, the sensor controller 330, the accounting module 340 and other various components of the micro control system 300 are all in operative communication with each other over suitable communication lines. Generally, the microprocessor 360 coordinates the operation and communications between the various sub-systems of the mailing machine 10.

Figure 3:
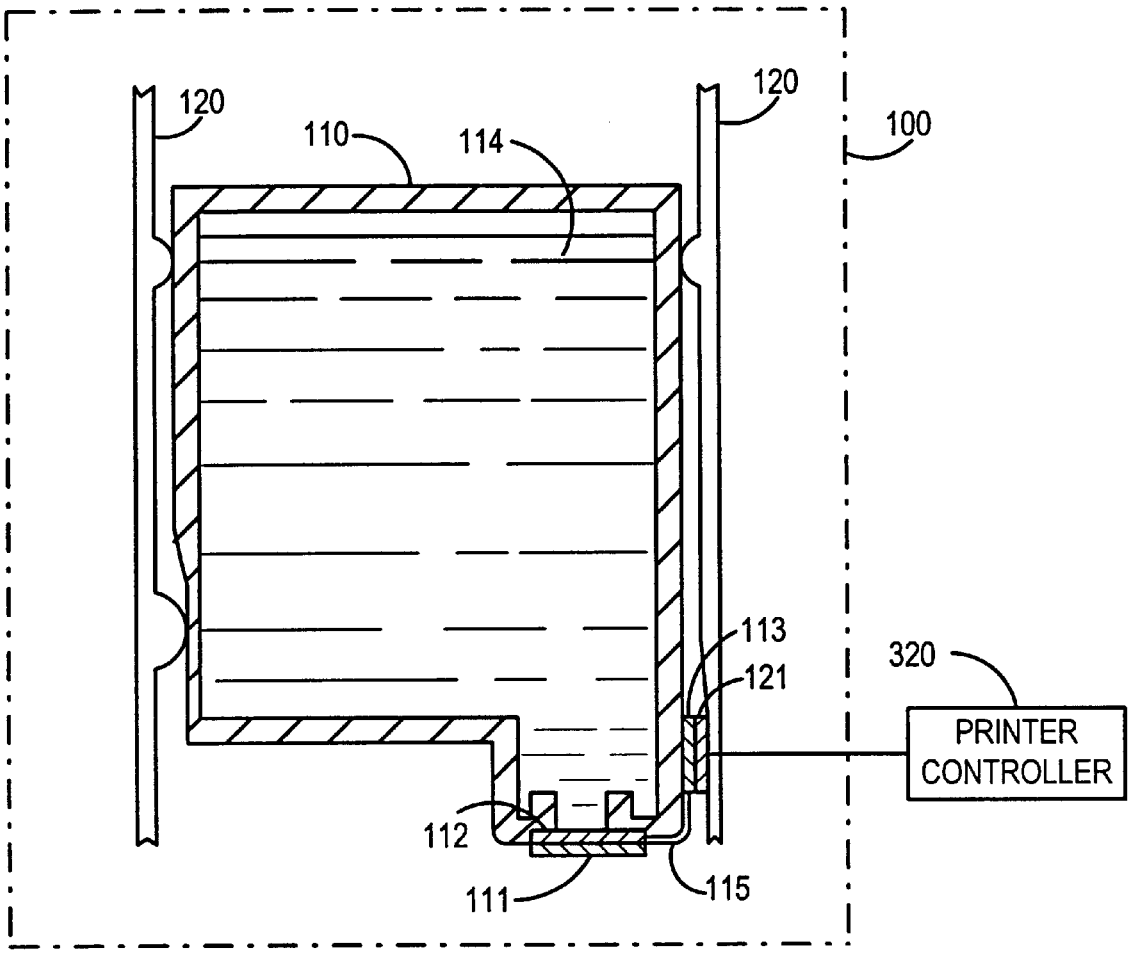
FIG. 3 is a simplified schematic of a sectional view of a printer module including an ink jet cartridge in accordance with the present invention.

Referring to FIG. 3, the printer module 100 is used for printing a postal indicia on the envelope 20 (not shown) and includes a carriage 120 and an ink jet cartridge 110 detachably mounted to the carriage 120 in conventional fashion using any suitable structure (not shown). The ink jet cartridge 110 includes a nozzle plate 111 including an array of nozzles (not shown), an actuator plate 112 including a plurality of ejection elements (not shown) corresponding to the array of nozzles and an ink supply 114 in flowing communication with the actuator plate 112 and the nozzle plate 111. Additionally, the cartridge 110 includes a contact pad 113 mounted to an exterior surface of the cartridge 110. The contact pad 113 is in operative communication with the actuator plate 112 via a flex strip 115. The carriage 120 also includes a contact pad 121 that is in mating relationship to the contact pad 113 of the cartridge 110. The contact pad 121 is in operative communication with the printer controller 320 so that the printer controller 320 may supply suitable drive signals to the actuator plate 112 of the cartridge 110.

The printer module 100 further includes a maintenance assembly (not shown) for capping and wiping the nozzle plate 111 and a repositioning assembly (not shown) for moving the carriage 120 and thus the cartridge 110 from a maintenance position to a print position. In the print position, the cartridge 110 is disposed above the path of travel of the envelope 20 so that printing may occur.

Each cartridge 110 is initially filled with a predetermined amount of the ink 114. Since the ink 114 is used during printing and maintenance operations, the ink 114 will be gradually consumed over time and eventually a new cartridge 110 will need to be installed. To keep track of the amount of the ink 114 available, the printer controller 320 estimates an amount of the ink 114 used during all operations and subtracts this amount from the predetermined amount initially available to obtain an estimate of an amount of the ink 114 remaining. Any conventional technique for estimating ink can be used, such as counting individual ink drops or counting postal indicias and maintenance operations (each consuming an estimated amount of the ink 114), may be employed. In the alternative, an active system (not shown), such as a providing a thermistor in the ink reservoir, can be employed for actively measuring the amount of remaining ink.

Those skilled in the art will appreciate that no matter which measurement technique is employed, the amount of the ink 114 remaining cannot be precisely determined because of the factors discussed above. Thus, the measurement techniques only provide an estimate of the amount of the ink 114 remaining. However, through empirical testing where a large number or cartridges 110 are inspected under various operating conditions, a confidence level or measure of the accuracy of the estimating technique employed can be determined.

It is important to note that the accuracy of the printer controller 320 in estimating the amount of the ink 114 remaining influences the determination as to whether or not the amount of the ink 114 remaining is sufficient to complete a printing operation. Since printing must be completed before the ink 114 actually runs out to prevent the loss of postal funds, some safety factor should be established so that printing is prohibited once the estimate of the ink 114 remaining reaches a predetermined threshold. That is, if empirical testing or other measures show that estimates of the amount of the ink 114 remaining are only accurate to within ±10% of the initial amount of the ink 114 originally supplied at manufacture, then a suitable prohibit printing condition would be when the estimates indicate that 85% of the initial amount of the ink 114 originally supplied at manufacture was consumed. This would represent a margin of safety of 5%. That is, under worst case conditions, 5% of the initial amount of the ink 114 originally supplied at manufacture would still be present when the prohibit printing condition is established. Depending upon the accuracy of the amount of the ink 114 remaining estimates and the amount of risk deemed appropriate with different safety factors, a wide variety of threshold values for a prohibit printing condition can be established. In any case, the threshold value at which the ink cartridge 110 is not allowed to print is set to an amount of the ink 114 which is less than the initial amount of ink that was supplied to the cartridge 110 at manufacture.

Figure 4:
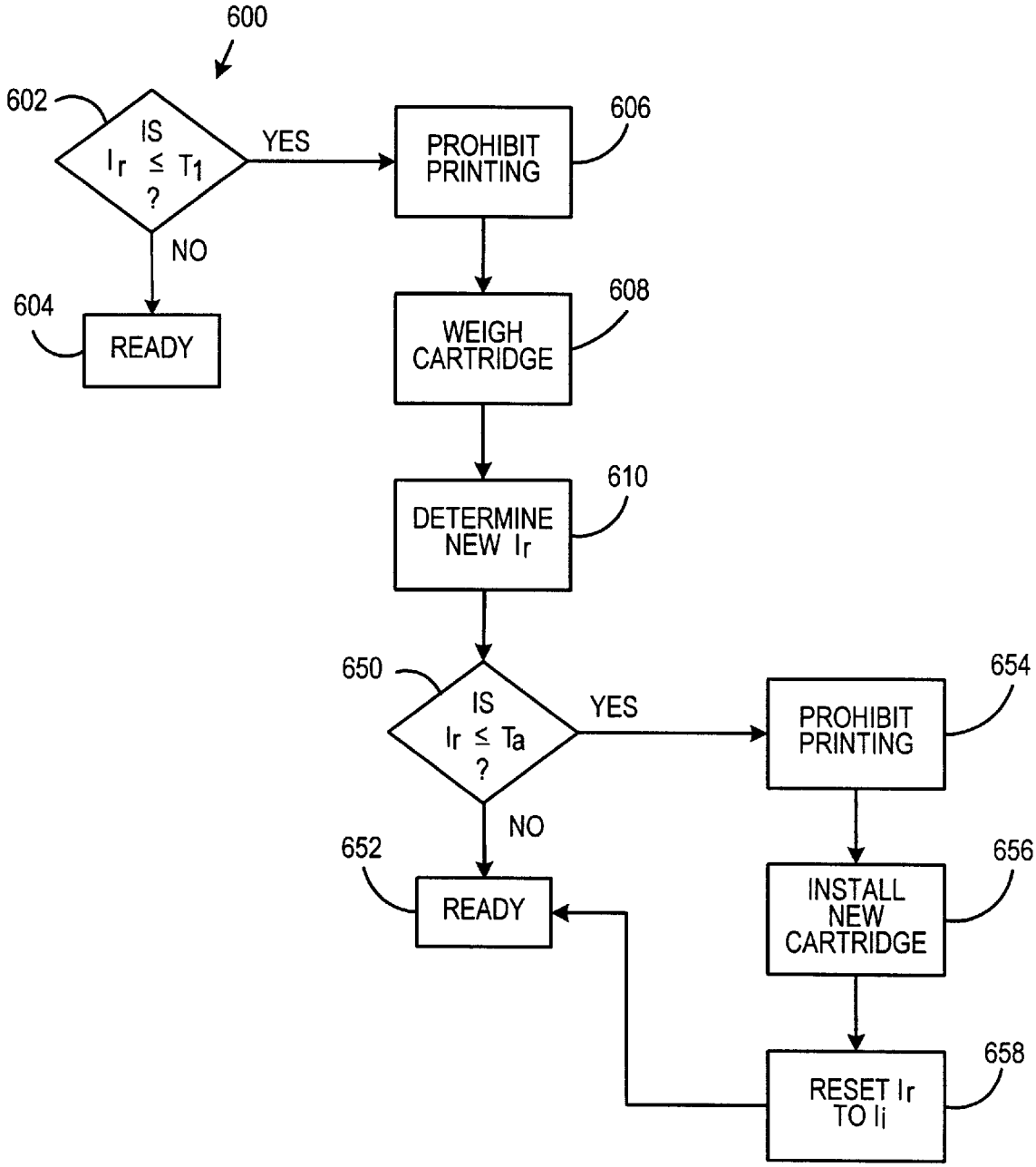
FIG. 4 is a flow chart showing the operation of the mailing machine in accordance with the present invention.

With the structure of the mailing machine 10 described as above, the operational characteristics will now be described. Referring primarily to FIG. 4 while referencing the structure of FIGS. 1, 2 and 3, a flow chart 600 of the operation of the mailing machine 10 in accordance with the present invention is shown. Generally, the activities contained within the flow chart 600 are coordinated by the micro control system 300 and more specifically at the supervision of the microprocessor 360. At 602, a determination is made whether or not the amount of the ink 114 remaining $I_r$ is less than or equal to a first threshold value $T_1$ (or some other predetermined event, such as: system power up, request of the operator or the like). The amount of the ink 114 remaining $I_r$ is determined using one of the estimating techniques described above while the first threshold value $T_1$ is established based upon the empirical testing. To continue the example discussed above, if the initial amount of the ink 114 supplied at manufacture $I_i$ is one hundred grams (100 g), then the first threshold value $T_1$ is fifteen grams (15 g) as a result of the estimating accuracy of ±10% and a safety factor of 50%. If at 602 the answer is no, then at 604 the mailing machine 10 is ready for normal operation because an adequate supply of the ink 114 exists to ensure that the ink 114 will not run out during the next printing operation.

On the other hand, if at 602 the answer is yes, then at 606 printing is prohibited. That is, the printer controller 320 does not supply drive signals to the cartridge 110 and the accounting module 340 does not dispense postal funds. Next, at 608 the operator is instructed to weigh the cartridge 110. In the preferred embodiment, this is accomplished by the microprocessor 360 causing the user interface 380 to display an appropriate message to the operator to place the cartridge 110 on the platform 392. In this manner, the weight of the cartridge 110 may be obtained and directly input to the micro control system 300 without operator entry. In the alternative, the operator could be instructed to weigh the cartridge 110 remotely and enter the actual weight via the keypad 382. Next, at 610 a new value for the amount of the ink 114 remaining $I_r$ is determined using the actual weight of the cartridge 110. That is, the actual weight of the cartridge 110 is subtracted from an initial weight of the cartridge 110 at manufacture (includes ink plus the hardware) resulting in the amount of the ink 114 actually remaining. Thus, the new value for the amount of the ink 114 remaining $I_r$ is then used during the operation of the printer module 100 to keep track of the amount of ink 114 remaining.

Next, at 650 a determination is made whether or not the amount of the ink 114 remaining $I_r$ is less than or equal to a second threshold value $T_2$. The second threshold value $T_2$ is less than the first threshold value $T_1$ and is also established based upon empirical testing. The second threshold value $T_2$ is established at a level where the ink 114 is still adequate to supply the array of nozzles (not shown) uniformly and evenly. Thus, the second threshold value $T_2$ is set to a non-zero number so that sputtering and any resulting degradation of print quality does not result. Also, the estimating accuracy and safety factor also influences the second threshold value $T_2$. Empirical testing as a result of operating the cartridge 110 under a variety of conditions has revealed that the second threshold value $T_2$ may be suitably set to about 7.5 grams (7.5 g). However, those skilled in the art will recognized that the second threshold value $T_2$, as well as the first threshold value $T_1$, can be set to any predetermined levels depending upon the performance and needs of the overall system.

If at 650 the answer is no, then the mailing machine 10 is ready for normal operation at 652. On the other hand, if at 650 the answer is yes, then at 654 printing is prohibited. Next, at 656 the operator is instructed to remove and dispose of the cartridge 110 and install a new cartridge 110. Here again, these instructions are provided via appropriate messages sent to the display 384. Next, at 658 the amount of the ink 114 remaining $I_r$ is reset to the initial amount of the ink 114 supplied at manufacture $I_i$ before control proceeds to 652.

In the preferred embodiment, the routine 600 is performed: at system power up/reboot; before each print cycle and after each print cycle. However, after the cartridge 110 has been weighted once, then operations 602 through 610 can be skipped. Those skilled in the art will recognize that there exists great flexibility on when the routine 600 is run and what portions of the routine 600 need to be run.

As an extension of the basic concepts of the present invention, the new value for the amount of the ink 114 remaining $I_r$ may be used to determine an approximate number of postal indicias that may be printed before running out of the ink 114. Generally, the postal indicia contains both fixed data (originating zip code, serial number, design graphics, etc.) and variable data (date, postage amount, etc.) within a predefined area of approximately 0.75 inches by 3.0 inches. Therefore, the amount of ink 114 necessary to print each postal indicia is generally within a very narrow range. This allows the micro control system 300 to utilize the new value for the amount of the ink 114 remaining $I_r$ and an approximation of an amount of ink 114 necessary to print one postal indicia to calculate the number of postal indicias that may be printed before running out of ink 114. Those skilled in the art will appreciate that considerations for maintenance operations may also be built into this calculation.

Many features of the preferred embodiment represent design choices selected to best exploit the inventive concept as implemented in a mailing machine. However, those skilled in the art will recognize that various modifications can be made without departing from the spirit of the present invention. For example, the preferred embodiments are described with respect to bubble jet technology, however, those skilled in the art will readily be able to adapt the inventive concepts to piezoelectric technology.

As another example, the preferred embodiments are described with respect to a cartridge which includes an ink supply and the print head (ejection elements and nozzles) along with other associated components. However, those skilled in the art will recognize that the inventive concepts of the present invention can be adapted to other configurations of the ink supply and the print head. One configuration involves an ink supply contained within a replaceable cartridge while the print head is physically separated from the replaceable cartridge.

As yet another example, the operations from 650 to 658 can be disregarded and replaced with a simple warning signal indicating that the ink supply is running low and that print quality should be monitored directly by the operator to determine when to replace the cartridge 110.

As still another example, the operator can be given the further flexibility to force the micro control system 300 to perform operations 602 through 610 at any time by entry of an appropriate command via the user interface 380.

Therefore, the inventive concept in its broader aspects is not limited to the specific details of the preferred embodiments but is defined by the appended claims and their equivalents.

What is claimed is:

1. An ink jet printer, comprising:

a replaceable cartridge having a supply of ink;

control means in operative communication with the cartridge for:

keeping an estimate of an amount of ink remaining in the cartridge; and providing a signal indicating that the cartridge is to be weighed in response to a predetermined event.

2. The ink jet printer of claim 1, wherein:

the predetermined event is the estimate of the amount of ink remaining reaching a first threshold value; and the control means is further for prohibiting operation of the cartridge when the estimate of the amount of ink remaining reaches the first threshold value.

3. The ink jet printer of claim 2, wherein:

the control means is further for:

receiving an indication of a weight for the cartridge; and determining a new estimate of the amount of ink remaining using the weight.

4. The ink jet printer of claim 1, wherein:

the control means is further for:

receiving an indication of a weight for the cartridge; and determining a new estimate of the amount of ink remaining using the weight.

5. A postage printing apparatus, comprising:

an ink jet printer including a replaceable cartridge having a supply of ink;

control means in operative communication with the cartridge for:

keeping an estimate of an amount of ink remaining in the cartridge; and providing a signal indicating that the cartridge is to be weighed in response to a predetermined event.

6. The postage printing apparatus of claim 5, wherein:

the predetermined event is the estimate of the amount of ink remaining reaching a first threshold value; and the control means is further for prohibiting operation of the cartridge when the estimate of the amount of ink remaining reaches the first threshold value.

7. The postage printing apparatus of claim 6, wherein:

the control means is further for:

receiving an indication of a weight for the cartridge; and determining a new estimate of the amount of ink remaining using the weight.

8. The postage printing apparatus of claim 7, wherein:

the ink jet printer prints a postal indicia in response to drive signals from the control means; and the postal indicia requires a substantially predictable amount of ink; and the control means is further for:

using the new estimate of the amount of ink remaining and the substantially predictable amount of ink of the postal indicia to determine an approximate number of postal indicias that may be printed with the new estimate of the amount of ink remaining; and providing a signal indicating the approximate number of postal indicias that may be printed.

9. The postage printing apparatus of claim 8, further comprising:

means for weighing a mailpiece, the means for weighing being in operative communication with the control means; and user interface means for providing communication between an operator and the postage printing apparatus, the user interface means being in operative communication with the control means; and wherein:

the signal indicating that the cartridge is to be weighed is displayed on the user interface means and instructs the operator to place the cartridge on the means for weighing; and the control means obtains the indication of the weight for the cartridge directly from the means for weighing.

10. The postage printing apparatus of claim 9, wherein:

the control means is further for:

keeping a revised estimate of the amount of ink remaining in the cartridge in relation to the new estimate of the amount of ink remaining in the cartridge determined from the weight; and when the revised estimate of the amount of ink remaining reaches a second threshold value less than the first threshold value, providing a signal indicating that a new cartridge is to be installed.

11. The postage printing apparatus of claim 5, wherein:

the control means is further for:

receiving an indication of a weight for the cartridge; and determining a new estimate of the amount of ink remaining using the weight.

12. The postage printing apparatus of claim 11, wherein:

the ink jet printer prints a postal indicia in response to drive signals from the control means; and the postal indicia requires a substantially predictable amount of ink; and the control means is further for:

using the new estimate of the amount of ink remaining and the substantially predictable amount of ink of the postal indicia to determine an approximate number of postal indicias that may be printed with the new estimate of the amount of ink remaining; and providing a signal indicating the approximate number of postal indicias that may be printed.

13. The postage printing apparatus of claim 7, wherein:

the predetermined event is one of the following: power up of the postage printing apparatus, receipt of a request to weigh the cartridge, or the estimate of the amount of ink remaining reaches a first threshold value.

14. A method of operating an ink jet printer, comprising the step(s) of:

providing for a replaceable cartridge having a supply of ink;

keeping an estimate of an amount of ink remaining in the cartridge; and providing a signal indicating that the cartridge is to be weighed in response to a predetermined event.

15. The method of claim 14, wherein:

the predetermined event is the estimate of the amount of ink remaining reaching a first threshold value; and further comprising the step(s) of:

when the estimate of the amount of ink remaining reaches a first threshold value, prohibiting operation of the cartridge when the estimate of the amount of ink remaining reaches the first threshold value.

16. The method of claim 15, further comprising the step(s) of:

receiving an indication of a weight for the cartridge; and determining a new estimate of the amount of ink remaining using the weight.

17. The method of claim 14, further comprising the step(s) of:

receiving an indication of a weight for the cartridge; and determining a new estimate of the amount of ink remaining using the weight.

18. A method of operating a postage printing system including an ink jet printer, comprising the step(s) of:

providing the ink jet printer with a replaceable cartridge having a supply of ink;

keeping an estimate of an amount of ink remaining in the cartridge; and providing a signal indicating that the cartridge is to be weighed in response to a predetermined event.

19. The method of claim 18, wherein:

the predetermined event is the estimate of the amount of ink remaining reaching a first threshold value; and further comprising the step(s) of:

prohibiting operation of the cartridge when the estimate of the amount of ink remaining reaches the first threshold value.

20. The method of claim 19, further comprising the step(s) of:

receiving an indication of a weight for the cartridge; and determining a new estimate of the amount of ink remaining using the weight.

21. The method of claim 20, further comprising the step(s) of:

printing a postal indicia in response to drive signals from the control means, the postal indicia requiring a substantially predictable amount of ink;

using the new estimate of the amount of ink remaining and the substantially predictable amount of ink of the postal indicia to determine an approximate number of postal indicias that may be printed with the new estimate of the amount of ink remaining; and providing a signal indicating the approximate number of postal indicias that may be printed.

22. The method of claim 21, wherein:

the postage printing system includes means for weighing a mailpiece and user interface means for providing communication between an operator and the postage printing apparatus; and further comprising the step(s) of:

instructing an operator to place the cartridge on the means for weighing; and obtaining the indication of the weight for the cartridge directly from the means for weighing.

23. The method of claim 22, further comprising the step(s) of:

keeping a revised estimate of the amount of ink remaining in the cartridge in relation to the new estimate of the amount of ink remaining in the cartridge determined from the weight; and when the revised estimate of the amount of ink remaining reaches a second threshold value less than the first threshold value, providing a signal indicating that a new cartridge is to be installed.

24. The method of claim 18, further comprising the step(s) of:

receiving an indication of a weight for the cartridge; and determining a new estimate of the amount of ink remaining using the weight.

25. The method of claim 24, further comprising the step(s) of:

printing a postal indicia in response to drive signals from the control means, the postal indicia requiring a substantially predictable amount of ink;

using the new estimate of the amount of ink remaining and the substantially predictable amount of ink of the postal indicia to determine an approximate number of postal indicias that may be printed with the new estimate of the amount of ink remaining; and providing a signal indicating the approximate number of postal indicias that may be printed.

26. The method of claim 20, wherein:

the predetermined event is one of the following: power up of the postage printing apparatus, receipt of a request to weigh the cartridge, or the estimate of the amount of ink remaining reaches a first threshold value.

* * * * *